United States Patent [19]

Boggavarapu

[11] 4,323,823

[45] Apr. 6, 1982

[54] UNITARY BALLAST STRUCTURE FOR OPERATING FOUR FLUORESCENT LAMPS

[75] Inventor: Rao L. Boggavarapu, Monroeville, Pa.

[73] Assignee: Westinghouse Electric Corp., Pittsburgh, Pa.

[21] Appl. No.: 150,480

[22] Filed: May 16, 1980

[51] Int. Cl.[3] ..... H05B 41/23

[52] U.S. Cl. ..... 315/254; 315/258; 315/276; 315/283; 315/DIG. 5

[58] Field of Search ..... 315/189, 192, 228, 254, 315/258, 276, 283, 324, DIG. 5; 336/155, 171

[56] References Cited

U.S. PATENT DOCUMENTS

| | | | |
|---|---|---|---|
| 2,404,254 | 7/1946 | Short | 315/228 |
| 2,620,459 | 12/1952 | Sawyer et al. | 315/98 |
| 2,685,662 | 8/1954 | Feinberg et al. | 315/138 |
| 3,059,143 | 10/1962 | Sola | 315/138 |
| 4,006,384 | 2/1977 | Elms et al. | 315/323 |
| 4,213,076 | 7/1980 | Walz | 315/276 X |

*Primary Examiner*—Eugene R. La Roche
*Attorney, Agent, or Firm*—W. D. Palmer

[57] ABSTRACT

Unitary ballast structure for starting and operating four fluorescent lamps comprising stacked magnetic iron laminations and coils retained thereon to provide two separate inductor means and a transformer means for heating multiple lamp electrode coils. The magnetic structure comprises a core member having a shell-type configuration with two main legs and six coil legs which define five coil-receiving windows. Coils retained on the second and third coil legs each comprise inductor means and occupy the first, second and third windows. An electrode-coil-heating transformer means is retained on the fifth coil leg and occupies the fourth and fifth windows. Each of the laminations which comprise the magnetic structure can have the same configuration which facilitates manufacture. Magnetic coupling between the different electrical components comprising the ballast structure is minimized, while still providing a compact, unitary ballast.

6 Claims, 5 Drawing Figures

UNITARY BALLAST STRUCTURE FOR OPERATING FOUR FLUORESCENT LAMPS

BACKGROUND OF THE INVENTION

This invention relates to fluorescent lamp ballasts and, more particularly, to a unitary ballast structure for starting and operating four fluorescent lamps.

U.S. Pat. No. 2,404,254, dated July 16, 1946 to Short discloses a fluorescent lamp ballast structure wherein multiple coils are mounted on a single core. Such cores can include air gaps as shown in U.S. Pat. No. 2,620,459, dated Dec. 2, 1952 to Sawyer et al.

Ballast structures comprising a separate filament transformer and reactor wound on the same core structure are disclosed in U.S. Pat. No. 3,059,143, dated Oct. 16, 1962 to Sola.

A multiple coil structure wound on a single core for operating four fluorescent lamps is described in U.S. Pat. No. 2,685,662, dated Aug. 3, 1954 to Feinberg et al.

The fluorescent lamp ballast art is highly developed and the most commonly used ballast, particularly for recessed fixture commercial applications, is the two-lamp series-sequence ballast which is generally referred to as a two-lamp rapid-start ballast. Such a ballast is described in detail in U.S. Pat. No. 2,796,554, dated June 18, 1957. In installations where four lamps are utilized in one fixture, it has been customary to incorporate two of these two lamp ballasts in each fixture. An alternative circuit by which four lamps can be operated from a single ballast is disclosed in U.S. Pat. No. 4,006,384, dated Feb. 1, 1977 to Elms et al.

SUMMARY OF THE INVENTION

There is provided a unitary ballast structure for starting and operating four fluorescent lamps with the structure comprising stacked magnetic iron laminations and insulated coils retained thereon to provide as electrical components two separate inductor means and lamp electrode-coil-heating transformer means, with minimized magnetic coupling between different ones of the electrical components. The unitary structure comprises a composite unitary magnetic core member formed of the stacked magnetic iron laminations and having a shell-type configuration with two main leg members and six coil leg members which together define five wire-coil-receiving windows.

The coil leg members include first and sixth coil leg members which project respectively from the extremities of each of the main leg members to form a continuous magnetic path about the periphery of the shell-type core. The coil leg members include a second coil leg member spaced by a predetermined distance from the first coil leg member to form a first inductor means coil-receiving window of predetermined dimensions and the second coil leg member includes therein an air gap of predetermined dimensions. A third coil leg member is spaced by a predetermined distance from the second coil leg member to form a second inductor means coil-receiving window of approximately double the size of the first coil-receiving window and the third coil leg member includes therein an air gap of predetermined dimensions. A fourth coil leg member is spaced from the third coil leg member by a predetermined distance to form a third coil-receiving window which is approximately the same size as the first coil-receiving window. A fifth coil leg member is spaced predetermined distances intermediate the fourth coil leg member and the sixth coil leg member to form fourth and fifth coil-receiving windows of predetermined dimensions.

An insulated wire coil is retained on the second coil leg member to occupy the first window and approximately half of the second window and the coil terminates in a pair of lead-in wires adapted to be connected in circuit to form a first inductor means. An insulated wire coil is retained on the third coil leg member to occupy the third window and the remaining half of the second window and terminates in a pair of lead-in wires which are adapted to be connected in circuit to form a second inductor means. A transformer primary winding coil and multiple secondary winding coils are retained on the fifth coil leg member to occupy the fourth and fifth windows, and each transformer winding coil terminates in separate lead-in wires which are adapted to be connected in circuit in order to provide heating potential for the fluorescent lamp electrodes. The magnetic structure and the physical separation of the first and second inductor means and the transformer means minimizes magnetic coupling therebetween while still providing a compact, unitary structure.

BRIEF DESCRIPTION OF THE DRAWINGS

For a better understanding of the invention, reference may be had to the preferred embodiment, exemplary of the invention, shown in the accompanying drawings in which.

DESCRIPTION OF THE PREFERRED EMBODIMENTS

Figure 1:
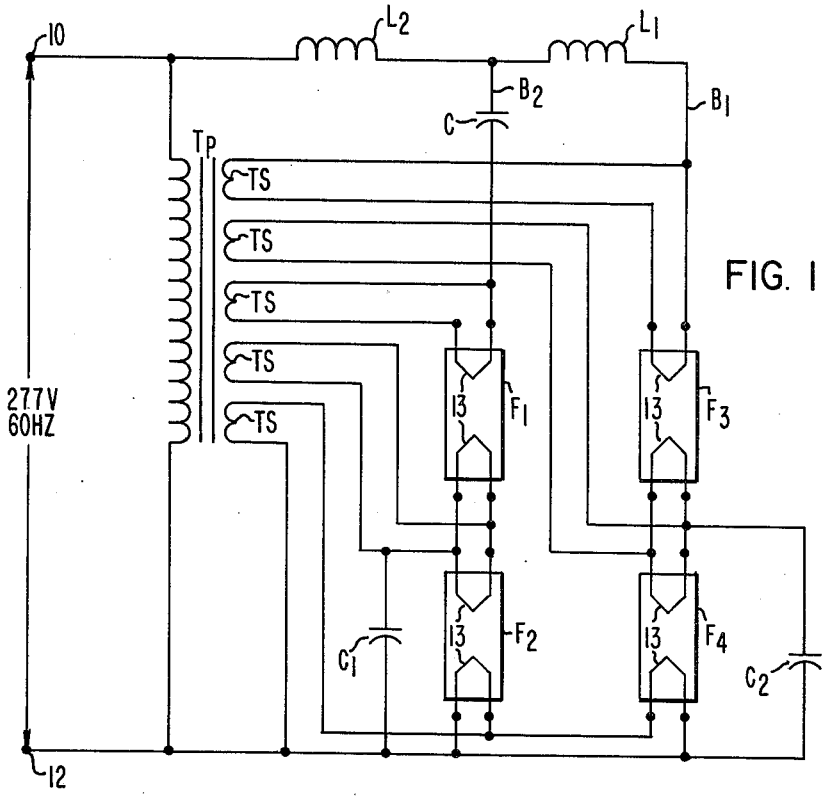
FIG. 1 is a circuit diagram of a four lamp ballast which utilizes the present unitary ballast structure.

The basic operating circuit for starting and operating four fluorescent lamps and which incorporates the present unitary ballast structure is shown in FIG. 1 and is also generally described in the aforementioned Pat. No. 4,006,384. Essentially, this circuit is what can be described as a lead-lag series-sequence starting and operating apparatus which comprises two parallel branch circuits $B_1$ and $B_2$. The circuit $B_2$ comprises a ballast capacitor C and two fluorescent lamps $F_1$ and $F_2$ in series. The other branch circuit $B_1$ comprises an inductor ballast $L_1$ and two more lamps $F_3$ and $F_4$ in series. An additional ballast inductor $L_2$ connects in series with the two parallel-connected circuits. The input terminals 10, 12 of the ballast apparatus are adapted to be connected across an AC power source. Starting capacitors $C_1$ and $C_2$ parallel individual lamps. A transformer having a primary $T_P$ is connected across the line and individual secondary windings $T_S$ connect to each of the lamp electrodes 13 in order to provide electrode coil heating potential. In the operation of this circuit, when the circuit is first energized, a small electrode heating potential is applied across each of the lamp electrodes in order to partially ionize the lamp starting gas. The lead circuit $B_2$ which includes the capacitor C starts first and the circuit path is through $L_2$, through C, through lamp $F_1$ and capacitor $C_1$. The voltage drop across $C_1$ is then sufficient to start the lamp $F_2$. The circuit $L_2$-C has a higher voltage developed at the inductor-capacitor junction due to series resonance and this higher voltage is sufficient to ignite the parallel circuit $B_1$ which contains the inductor $L_1$. Starting of this circuit $B_1$ is similar in that the lamp $F_3$ strikes first with the lamp $F_4$ then striking due to the voltage drop across $C_2$, to provide a series-sequence starting affect. The circuit can thus be described as a lead circuit $B_2$, lag circuit $B_1$ which starts in a series-sequence mode of operation. As an alternative embodiment, the transformer primary $T_P$ can be connected across the lag circuit $B_1$ which will minimize the power consumed by the transformer once the circuit is operating, but it is preferred to connect the transformer primary $T_P$ across the input terminals 10, 12. To complete the description of the circuit, each of the lamps are of a standard 40 watt T12 design and the circuit is particularly adapted to be operated from a 277 volt, 60 Hz input.

Figure 2:
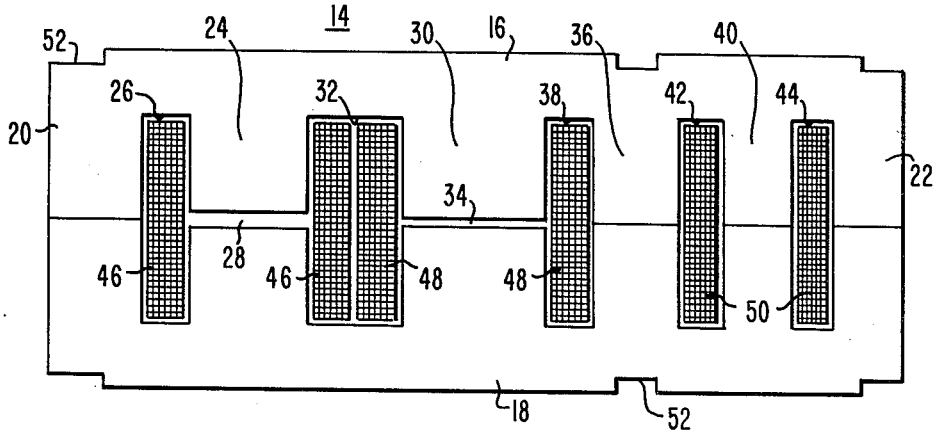
FIG. 2 is a plan view of the stacked magnetic iron laminations showing the air gaps, windows and locations of the coils.

In FIG. 2 is shown a plan view of the magnetic portion of the ballast structure for starting and operating the four lamps in the circuit as shown in FIG. 1. This ballast structure comprises stacked magnetic iron laminations and insulated coils retained thereon to provide as electrical components two separate inductor means, $L_1$ and $L_2$, and lamp electrode-coil-heating transformer means comprising the transformer primary $T_P$ and the secondary windings $T_S$, with the structure providing minimized magnetic coupling between different ones of each of the electrical components. More specifically, the unitary structure comprises a composite unitary magnetic core member 14 formed of stacked magnetic iron laminations and having a shell-type configuration with two main leg members 16 and 18 and six coil leg members which together define five wire-coil-receiving windows.

The coil leg members 16 and 18 include a first coil leg member 20 and a sixth coil leg member 22 projecting respectively from the extremities of each main leg member in order to form a continuous magnetic path about the periphery of the shell-type core. The coil leg members include a second coil leg member 24 spaced by a predetermined distance from the first coil leg member 20 to form a first inductor means coil-receiving window 26 of predetermined dimensions. The second coil leg member 24 also includes an air gap 28 of predetermined dimensions.

The coil leg members also include a third coil leg member 30 which is spaced a predetermined distance from the second coil leg member 24 in order to form a second inductor means coil-receiving window 32 of predetermined dimensions which occupies approximately double the area of the first coil-receiving window 26. The third coil leg member 30 also includes therein an air gap 34 of predetermined dimensions.

The coil leg members also include a fourth coil leg member 36 which is spaced from the third coil leg member 30 by a predetermined distance to form a third coil receiving window 38 which is approximately the same size as the first coil receiving window 26.

The coil leg members also include a fifth coil leg member 40 which is spaced predetermined distances intermediate the fourth coil leg member 36 and the sixth coil leg member 22 in order to form a fourth coil receiving window 42 and a fifth coil receiving window 44 of predetermined dimensions.

An insulated wire coil 46 is retained on the second coil leg member 24 to occupy the first window 16 and approximately half of the second window 32 in order to form a first inductor means $L_1$ as shown in FIG. 1. Another insulated wire coil 48 is retained on the third coil leg member 30 to occupy the third window 38 and the remaining half of the second window 32 and this second coil forms the inductor $L_2$ as shown in FIG. 1. A transformer coil 50 comprising the transformer primary $T_P$ and the multiple transformer secondaries $T_S$ are retained on the fifth coil leg 40 to occupy the coil receiving windows 42 and 44. The shell-type magnetic structure minimizes stray flux and the magnetic construction and physical separation of the individual electrical components comprising the ballast minimizes magnetic coupling between the components while still providing a compact, unitary structure.

As a specific example, each of the laminations is formed of magnetic iron sheet having a thickness of 0.018 in. (0.046 cm.). The stack height of the laminations is 0.785 inch (1.99 cm.). For operating four lamps in the manner as specified, inductor $L_1$ is rated at 0.44 amp at 160 volts and inductor $L_2$ is rated at 0.68 amp at 65 volts. The transformer primary is designed to operate from 277 volts with 5 secondary coils each providing 3.6 volts rms for filament heating. C is rated at 4.0 $\mu$f, 300 volts and $C_1$ and $C_2$ are rated at 0.68 $\mu$f, 400 volts. The air gaps 28 and 34 provided in the legs 24 and 30 provide the required inductance for the coils $L_1$ and $L_2$ which are placed on these legs and mutual coupling between the coils $L_1$ and $L_2$ is minimized by the presence of these air gaps. Most of the flux produced by the coils $L_1$ and $L_2$ takes the return path in legs 20 and 36. The flux of the transformer coil takes the return path in legs 36 and 22.

The length of the air gaps 28 and 34 is calculated by the following equation:

$$(P_Q/Ug=0.59B_g^2 \text{Vars/inch}^3;$$

wherein:

$P_Q$=reactive power of the coil in Vars

Ug=volume of the air gap in in$^3$ $B_g$=maximum flux density in the air gap in KL/in$^2$.

As a specific example, each of the main coil legs 16 and 18 have an overall length of 5.4 in. (13.7 cm.). The windows 26 and 38 have dimensions of 1.425 in. (3.62 cm.) by 0.3 in. (0.76 cm.) and the window 32 has dimensions of 1.425 in. (3.62 cm.) by 0.625 in. (1.59 cm.). Each of the windows 42 and 44 have dimensions of 1.425 in. (3.62 cm.) by 0.2 in. (0.51 cm.).

In the preferred form of the ballast structure, the magnetic iron members are formed of two lamination stacks each comprising one of the main leg members with six coil leg segments extending therefrom at right angles thereto with each of the lamination stacks inverted with respect to one another with extending portions of certain of the coil leg segments abutting. There is also provided means for holding the lamination stacks in abutting relationship such as the strap receiving notches 52 as shown in FIG. 2. In the preferred form wherein the lamination stacks are inverted with respect to one another, only one punching need by utilized. In such a construction, each of the coil leg members is formed of two coil leg member segments of equal dimensions. The inductor or choke coils $L_1$ and $L_2$ are separately wound as are the transformer coils and the magnetic structure is then simply fitted into the wound coil members and the assembly completed.

Figure 3:
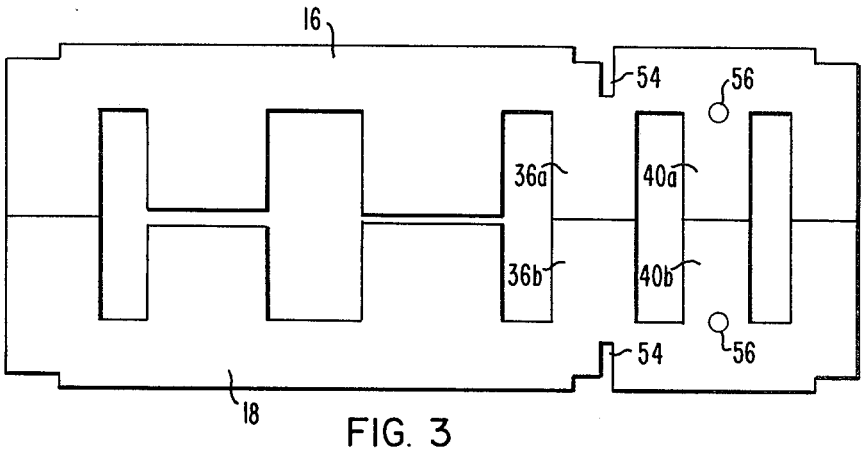
FIG. 3 is a plan view of the stacked magnetic laminations showing alternative embodiments for further reducing any tendency for magnetic coupling between the chokes and the transformer.

In FIG. 3 are shown alternative constructions which can be utilized to substantially eliminate any tendency for magnetic coupling between the inductor members $L_1$ and $L_2$ and the transformer. As one embodiment, small slots 54 each having a length of 0.2 in. (0.51 cm.) and a width of 0.04 in. (0.1 cm.) can be included in each main leg member portion 16, 18, of each lamination stack proximate each fourth coil leg member segment 36*a*, 36*b* which forms an aligned slot 54 through each lamination stack. As another embodiment which minimizes any tendency for magnetic coupling between the inductors and the transformer, a small aperture 56 can be included proximate each fifth coil leg member segment 40*a*, 40*b* in order to form an aligned aperture through each lamination stack.

Figure 4:
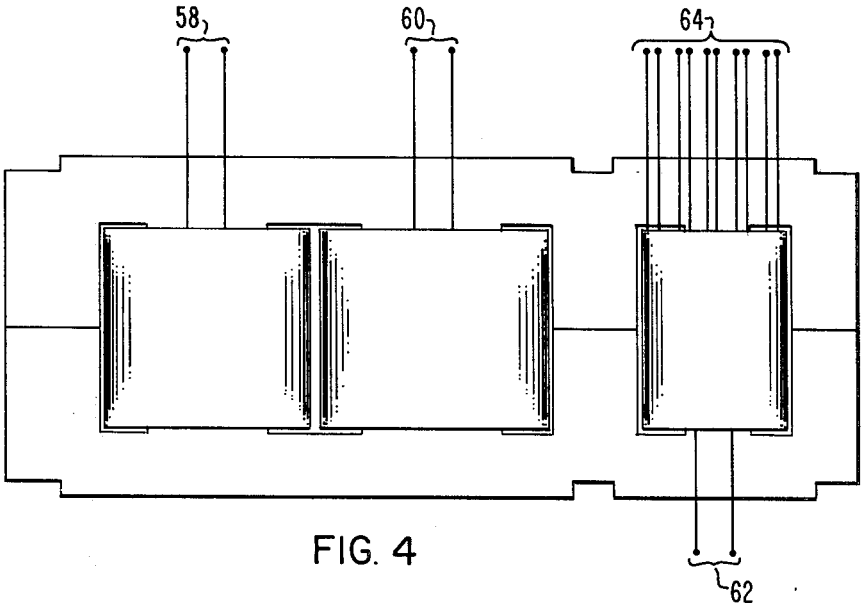
FIG. 4 is a plan view of the magnetic structure with the coils retained thereon.

The coils as mounted on the unitary magnetic core member are shown in FIG. 4 wherein the choke or inductor $L_1$ terminates in a pair of lead-in wires 58 adapted to be connected in circuit in FIG. 1, the inductor $L_2$ terminates in a pair of lead-in wires 60 adapted to be connected in the circuit as shown in FIG. 1, and the transformer T has a pair of lead-in wires 62 adapted to be connected across the line and five pairs of secondary lead-in wires 64 adapted to be connected in circuit to provide electrode heating in the manner as shown in FIG. 1.

Figure 5:
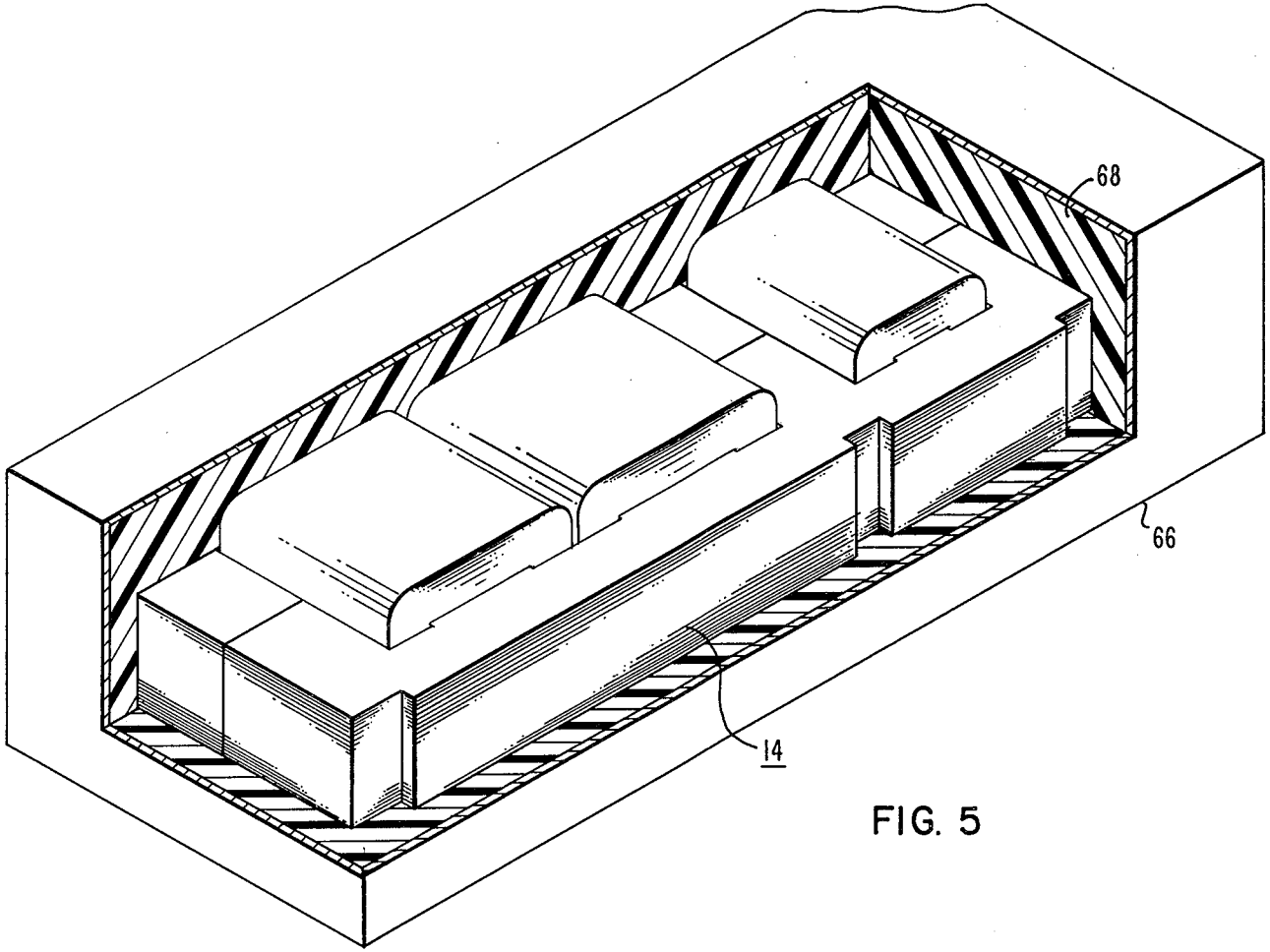
FIG. 5 is an isometric view, partly broken away, showing the unitary ballast structure as operatively retained and potted in a box-like casing.

A practical embodiment of the present unitary ballast structure is shown in FIG. 5 wherein a rectangular box-like casing 66 which can be formed of metal is so conformed that the composite unitary magnetic member 14 snugly fits therein in order to hold the individual lamination stacks together in operative relationship. A spacing is provided in the casing 66 at one end thereof to hold the necessary capacitors C, $C_1$ and $C_2$ and the entire assembly is then potted by vacuum impregnation with epoxy 68 or by utilizing other suitable potting compound such as asphalt.

The foregoing ballast is very economical with excellent performance for operating four lamps with about half the electrical ballast losses which are realized when using two conventional two-lamp ballasts. Air gaps which are utilized are enclosed by the coils so that leakage flux is minimized and magnetizing current in the transformer is reduced.

I claim:

1. A unitary ballast structure for starting and operating four fluorescent lamps, said ballast structure comprising stacked magnetic iron laminations and insulated coils retained thereon to provide as electrical components two separate inductor means and lamp electrode-coil-heating transformer means, with minimized magnetic coupling between different ones of said electrical components, said unitary structure comprising:

(a) a composite unitary magnetic core member formed of stacked magnetic iron laminations and having a shell-type configuration with two main leg members and six coil leg members which together define five wire-coil-receiving windows;

(b) said coil leg members including first and sixth coil leg members projecting respectively from the extremities of each said main leg member to form a continuous magnetic path about the periphery of said shell-type core;

(c) said coil leg members including a second coil leg member spaced by a predetermined distance from said first coil leg member to form a first inductor means coil-receiving window of predetermined dimensions, and said second coil leg member including therein an air gap of predetermined dimensions;

(d) said coil leg members including a third coil leg member spaced by a predetermined distance from said second coil leg member to form a second inductor means coil-receiving window of approximately double the size of said first coil-receiving window, and said third coil leg member including therein an air gap of predetermined dimensions;

(e) said coil leg members including a fourth coil leg member spaced from said third coil leg member by a predetermined distance to form a third coil-receiving window approximately the same size as said first coil-receiving window;

(f) said coil leg members including a fifth coil leg member spaced predetermined distances intermediate said fourth coil leg member and said sixth coil leg member to form fourth and fifth coil-receiving windows of predetermined dimensions;

(g) an insulated wire coil retained on second coil leg member to occupy said first window and approximately half said second window and terminating in a pair lead-in wires adapted to be connected in circuit to form a first inductor means;

(h) an insulated wire coil retained on said third coil leg member to occupy said third window and the remaining half of said second window and terminating in a pair of lead-in wires adapted to be connected in circuit to form a second inductor means; and (i) a transformer primary winding coil and multiple secondary winding coils retained on said fifth coil leg member to occupy said fourth and said fifth windows, and each said transformer winding coil terminating in separate lead-in wires adapted to be connected in circuit; whereby the physical separation of said first and said second inductor means and said transformer means minimizes magnetic coupling therebetween while still providing a compact unitary structure.

2. A unitary ballast structure for starting and operating four fluorescent lamps, said ballast structure comprising stacked magnetic iron laminations and insulated coils retained thereon to provide as electrical components two separate inductor means and lamp electrode-coil-heating transformer means, with minimized magnetic coupling between different ones of said electrical components, said unitary structure comprising:

(a) a composite unitary magnetic member of a shell-type configuration having two main leg members and six coil leg members which together define five wire-coil-receiving windows, said composite magnetic core member formed as a plurality of stacked magnetic iron laminations which in turn are formed as separable lamination stacks, each of said lamination stacks comprising one of said main leg members having six coil leg segments extending therefrom at right angles thereto, said lamination stacks being inverted with respect to one another with extending portions of certain of said coil leg segments abutting, and means for holding said lamination stacks in abutting relationship;

(b) each said lamination stack having first and sixth coil leg member segments projecting respectively from the extremities of each said main leg member, with projecting portions of said first and sixth coil leg member segments abutting to form a continuous magnetic path about the periphery of said shell-type core;

(c) each said lamination stack having second coil leg member segments spaced by a predetermined distance from said first coil leg member segments to form a first inductor coil-receiving window of predetermined dimensions, with the projecting portions of said second coil leg member segments having therebetween an air gap of predetermined dimensions;

(d) each said laminations stack having third coil leg member segments spaced by a predetermined distance from said second coil leg member segments to form a second inductor coil-receiving window of approximately double the size of said first coil receiving window, with the projecting portions of said third coil leg member segments having therebetween an air gap of predetermined dimensions;

(e) each said lamination stack having fourth coil leg member segments spaced from said third coil leg member segments by a predetermined distance to form a third coil-receiving window approximately the same size as said first coil-receiving window, with projecting portions of said third coil leg member segments abutting;

(f) each said lamination stack having fifth coil leg member segments spaced predetermined distances intermediate said fourth coil leg member segments and said sixth coil leg member segments to form fourth and fifth coil-receiving windows of predetermined dimensions, and the projecting extremities of said fifth coil leg member segments including therebetween at most only a small air gap;

(g) an insulated wire coil retained on said second coil leg members to occupy said first window and approximately half said second window and terminating in a pair lead-in wires adapted to be connected in circuit to form a first inductor means;

(h) an insulated wire coil retained on said third coil leg members to occupy said third window and the remaining half of said second window and terminating in a pair of lead-in wires adapted to be connected in circuit to form a second inductor means;

(i) a transformer primary winding coil and multiple secondary winding coils retained on said fifth coil leg members to occupy said fourth and said fifth windows, and each said transformer winding coil terminating in separate lead-in wires adapted to be connected in circuit; whereby the physical separation of said first and said second inductor means and said transformer means minimizes magnetic coupling therebetween while still providing a compact unitary structure.

3. The unitary ballast structure as specified in claim 2, wherein each said magnetic iron lamination of each said separable lamination stack has the identical configuration.

4. The unitary ballast structure as specified in claim 2, wherein a small slot of predetermined dimensions is included in each said main leg member portion of each said lamination stack proximate each said fourth coil leg member segment to form an aligned slot through each said lamination stack to minimize any magnetic coupling between said first and said second inductor means and said transformer means.

5. The unitary ballast structure as specified in claim 2, wherein a small aperture of predetermined dimensions is included in each said fifth coil leg member segment of each said lamination stack to form an aligned aperture through each said lamination stack to minimize any magnetic coupling between said first and said second inductor means and said transformer means.

6. The unitary ballast structure as specified in claim 2, wherein a rectangular box-like casing is provided about said unitary ballast structure, said composite unitary magnetic member snugly fits into said box-like casing to hold said lamination stacks together in operative relationship, and potting compound fills remaining voids within said box-like casing.

* * * * *